United States Patent [19]

Bauer et al.

[11] 4,200,204

[45] Apr. 29, 1980

[54] DISPENSING CONTAINER WITH PRESSURE FLUID OPERATED DISPENSING PUMP

[75] Inventors: Daniel Bauer, Le Raincy; Jean-Paul Beck, Paris; Gérard Braque, Mitry-le-Neuf, all of France

[73] Assignee: L'Oreal, Paris, France

[21] Appl. No.: 883,672

[22] Filed: Mar. 6, 1978

[30] Foreign Application Priority Data

Mar. 18, 1977 [FR] France ..... 77 08188

[51] Int. Cl.[2] ..... B67D 5/64

[52] U.S. Cl. ..... 222/133; 222/321; 222/341; 222/381; 222/385; 239/308; 239/322

[58] Field of Search ..... 222/129.2, 133, 145, 222/148, 321, 334, 340, 341, 373, 379–385, 504, 509, 4, 399; 239/112, 113, 308, 332, 333; 92/129

[56] References Cited

U.S. PATENT DOCUMENTS

| | | | |
|---|---|---|---|
| 2,325,210 | 7/1943 | Swihart | 222/382 |
| 2,888,208 | 5/1959 | Fedit | 239/308 |
| 3,128,018 | 4/1964 | Corsette et al. | 222/385 X |
| 3,455,487 | 7/1969 | Crippen et al. | 222/334 X |
| 3,675,824 | 7/1972 | Hein | 239/308 X |
| 3,882,882 | 5/1975 | Preisie | 222/334 X |

*Primary Examiner*—Robert J. Spar
*Assistant Examiner*—Fred A. Silverberg
*Attorney, Agent, or Firm*—Brisebois & Kruger

[57] ABSTRACT

A container for storing and dispensing a liquid product includes a pump operated by a reciprocable control member and associated with a pneumatic servo system. The actuation is achieved by supply of gas pressure, for example, from a reservoir of gas at a pressure of the order of 5 bars, and this is used to actuate the control member of the pump, for example a stepped piston incorporating a pressure multiplying effect. Much higher operating forces on the reciprocable control member can be achieved with this system than were possible by purely manual operation of the valve control member.

21 Claims, 6 Drawing Figures

DISPENSING CONTAINER WITH PRESSURE FLUID OPERATED DISPENSING PUMP

It is well known that for the storage and dispensing of a liquid product, such as a cosmetic product, bottles or cans are used which are connected to manual ejection pumps. These pumps are frequently connected to a dip tube allowing the liquid to be dispensed, which is contained in the container, to be directed up to the pump which ensures its ejection. The dispensing operation is effected by generally acting on a push button which is subjected to alternating displacements to cause the lowering of the piston with which the hand pump is provided and the dispensing of a given quantity of the liquid product.

Functioning of a device of this kind is effected with a relatively low ejection pressure, of the order of a few bars. Now it has been found that in many cases, this pressure is not sufficient to ensure a satisfactory atomisation of the liquid to be dispensed, especially when one is concerned with a relatively viscous cosmetic product such as hair lacquer. There is, moreover, a risk of the spray nozzle becoming rapidly obstructed in these low pressure conditions, which entails the whole storage and dispensing unit being put out of action.

To improve the quality of atomisation, it has already been proposed to increase the ejection pressure by relying on pressurised containers of the "aerosol container" type in which the product to be dispensed is stored under the pressure of a gas propellant. Nevertheless, although the result is thus improved, it has been suggested that the use of the usual propellant gases ought to be avoided for the protection of the environment.

The object of the present invention is to remedy these aforementioned drawbacks and for this purpose, it is proposed to provide an un-pressurised container connected to an ejection pump whose operation is ensured by a system of pneumatic assistance depending on the user's action.

According to the invention we provide a container for storing and dispensing a liquid product comprising a container vessel and a pump comprising a dispensing chamber communicating by way of a valve with at least one ejection orifice and by way of another valve, with the inside of the container vessel, the introduction of the liquid product into the dispensing chamber and its discharge from the said chamber towards the ejection orifice being effected with the help of a movable control member having an alternating displacement, and being driven by means of gas pressure acting on one end thereof during a dispensing operation.

The auxiliary gas pressure necessary for the pneumatic assistance may be delivered by a pressurised reservoir of the "aerosol container" type containing, for instance, a liquefied gas under relatively reduced pressure. This auxiliary system conveniently comprises a movable control member in the form of a stepped piston capable of siding in a stepped cylinder. This movable control device makes it possible, during a dispensing operation, to amplify (or divide) the action of the compressed gas applied to it by choice of the ratio of the effective areas of the two piston ends. Thus on the basis of a pressurised reservoir containing a common liquefied gas such as a butane/propane mixture at a pressure of 5 bars, the bearing force on the push button of a pump may be quite safely increased, it may for instance, be quadrupled in comparison to the force exerted manually. This results in an ejection pressure of the order of 20 bars (instead of 5 bars which is generally the pressure obtained manually without assistance). It should also be noted that the storage, transport or handling of the container according to the invention may be effected in all safety without any risk of explosion, since the pressure obtaining in the auxiliary container may, as has been seen, be very low, of the order of a few bars. Moreover, the risk of clogging of the spray nozzle can be altogether obviated, even if one is concerned with a very viscous product such as hair lacquer, for example, by making provision to deflect some of the discharged compressed gas into the spray nozzle with the effect of both improving the spray jet and clearing the said nozzle at the end of the dispensing operation.

In a preferred embodiment, the compressed gas acting on the movable control device is delivered by a pressurised reservoir fitted with an ejection valve, the user manually causing the said ejection valve to open during a dispensing operation. The pressurised container is capable of being displaced within a guide duct whose bottom is pierced by an orifice ensuring communication with a hollow cylinder within which the movable device may slide, the ejection valve of the pressurised reservoir being arranged opposite the said communication orifice. The outlet tube of the valve with which the pressurized reservoir is fitted, comes to bear during each opening operation of the said valve against an O ring seal arranged in a cylindrical cavity between the communication orifice and the guide duct. In the wall of the guide duct of the pressurised reservoir preferably near the zone occupied by the valve of the said container, at least one port may be arranged to allow escape of the gas delivered by the pressurised reservoir during one dispensing operation. The part of the pressurised reservoir which projects in relation to the guide duct is arranged within a cap set on the guide duct, the said cap being capable of sliding in the said duct under the effect of the pressure exerted by the user.

In a first advantageous embodiment, the pneumatic servo system according to the invention may be associated with an ejection pump of the known type mounted on a container vessel accommodating the liquid product to be dispensed. In this case, the head of a container comprising a hand ejection pump may be capped with an auxiliary device allowing the pneumatic servo assistance to be obtained. Such an auxiliary device comprises, as the movable control member, a piston which can slide within a hollow cylinder to be fitted on a hand pump of the conventional type, the piston acting with its side which is not subjected to the pressure of the compressed gas, on the push button of the said pump.

In a second advantageous embodiment, the movable control member subjected to the action of the compressed gas is an element of the pump whose displacement in one direction, produces the entry of the liquid product into the dispensing chamber and in the other direction, produces its ejection through the ejection nozzle. In this embodiment, the movable control member may be displaced within a hollow cylinder in the pump barrel. The hollow cylinder is conveniently stepped, comprising a zone with an enlarged cross section accommodating the end of the movable control device on which the compressed gas acts during a dispensing operation, and a zone with a constricted cross section accommodating the other end of the said movable control member, the dispensing chamber of the pump being laterally bounded by the cylinder zone of the smaller cross section. Within the wall of the pump barrel and/or in the wall of the movable control member, a tube may conveniently be arranged to allow the passage of a quantity of the discharged compressed gas towards the ejection nozzle.

In a first variant of the embodiment, the sliding control member is a piston placed between two elastically deformable membranes, these two membranes being arranged parallel to each other and perpendicularly to the pump axis, the upper membrane obturating the enlarged cross section end of the hollow cylinder and withstanding, during a dispensing operation, the pressure of the compressed gas, while the lower membrane obturates the smaller cross section end of the said hollow cylinder and constituting a wall of the dispensing chamber of the pump.

In a second variation of this embodiment, the sliding member is a piston of a general cylindrical shape capable of being displaced within the hollow cylinder of the pump barrel against a return spring arranged within the said pump barrel. In this case, the ejection orifice of the pump may be constituted by a nozzle either carried by the side wall of the piston or by the pump barrel. The piston may carry a guide finger projecting from its side wall and displaceable within a rectangular groove in the pump barrel, the said groove extending parallel to the sliding axis of the piston. The return spring connected to the piston may be a helical spring arranged either within the dispensing chamber of the pump or surrounding the dispensing chamber, the said spring then bearing in this latter case, on the one hand, on the pump barrel and, on the other hand, on the part of the piston having the larger cross section.

In a third alternative embodiment, the movable control member is an elastic membrane on one side of which the compressed gas acts during a dispensing operation, the other side of the membrane constituting a wall of the dispensing chamber of the pump. The elastic membrane is conveniently dome-shaped, with the concave side of the membrane being the side facing towards the dispensing chamber; the dispensing chamber presents a concave curved wall opposite the membrane and on which wall the membrane may rest when it is subjected to pressure by the compressed gas, grooves being cut in this curved concave wall.

In this third alternative embodiment when by depressing the pressurised reservoir the user actuates the outlet valve and effects admission of compressed gas on the dome-shaped membrane, this latter is elastically deformed and causes a dose of the product contained in the dispensing chamber to be ejected. When the user releases his depressing action, the membrane is no longer subjected to action by the compressed gas and returns to its initial position because of its own elasticity which, in this case, acts as a return spring.

The storage and dispensing container, in accordance with the invention, may be used not only to obtain atomisation but also to project a high pressure jet, for instance, a jet of liquid for dental care. In this application, the ejection nozzle is conveniently placed at the end of a tubular duct communicating with the interior of the pump dispensing chamber, this tubular duct projecting to the outside of this pump barrel and extending perpendicularly to the axis of the said pump barrel. Thus, thanks to the tubular duct, it is possible to position the ejection nozzle conveniently on the zone of the denture to which one wishes to apply the cleaning or treating product. Moreover, the dispensing operation may be effected due to the pneumatic servo assistance system without in practice changing the initially selected position for the ejection nozzle.

In order that the present invention may more readily be understood several embodiments thereof, illustrated by way of purely illustrative and non-restrictive examples in the accompanying drawings will now be described with reference to these drawings in which:

FIG. 1 schematically represents an axial cross section of a storage and dispensing container whose hand pump incorporates a pneumatic assistance system in accordance with the present invention;

Figure 1:
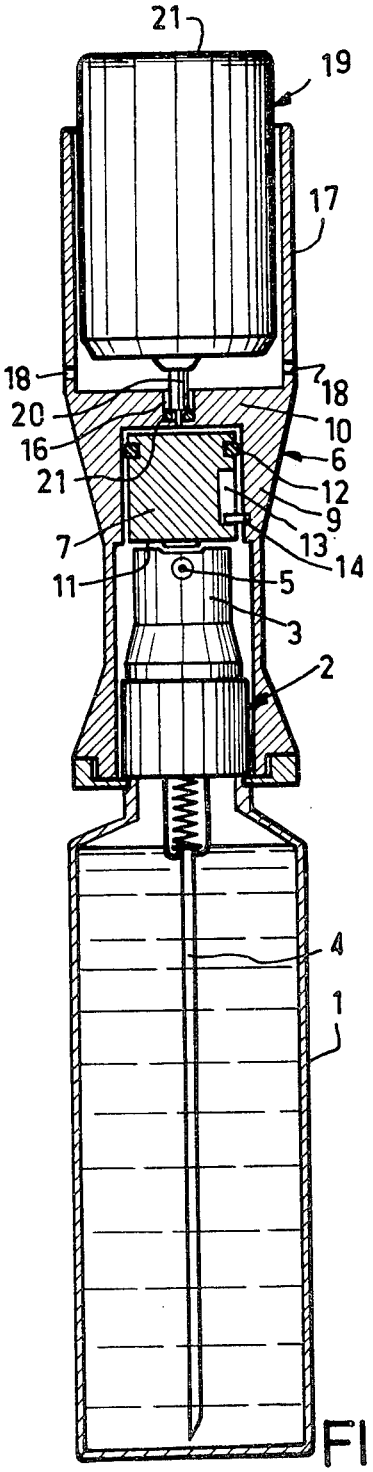

Referring to FIG. 1 of the drawing there will be seen an un-pressurised container vessel 1 containing a liquid product, in this case a cosmetic product. On the neck of container vessel 1, is mounted a pump 2 with an alternating action. This pump 2 is of conventional type and allows, during each depression of its push button 3, dispensing of a predetermined quantity of the product stored in container vessel 1. Hand pump 2 is connected to a dip tube 4 arranged within container vessel 1, this tube allowing the passage of the liquid stored in container vessel 1 into the pump barrel from which the liquid is then ejected by way of the orifice of an ejection nozzle 5 carried by the push button 3.

The essential feature of the device of FIG. 1 is that the functioning of the conventional type of hand pump 3 is ensured by a system of pneumatic assistance depending on the action of the user. The servo device, generally designated 6, comprises a piston 7, capable of sliding within a hollow cylinder 9 which is closed at one of its ends by end panel 10 and is open at its other end. The hollow cylinder 9 is set with its open end just above the pump barrel of hand pump 2. Cylinder 9 may be fixed above the pump barrel by any suitable means. Piston 7 is of a general cylindrical shape and bears with its end 11 on push button 3 of hand pump 2. Around the cylindrical side wall of piston 7, is an O ring seal 12 which co-operates with the inner cylindrical wall of cylinder 9 to ensure a seal. A stop 14 fixed to cylinder 9 engages within a rectangular groove 13 cut in the side wall of piston 7 which extends parallel to the sliding axis of the said piston. The co-operation of stop 14 with groove 13 allows the travel of the piston 7 to be limited within the hollow cylinder 9 and to avoid rotation of the piston 7 in relation to the cylinder 9.

The upper end wall 10 of the hollow cylinder 9 is pierced by an opening 16 leading into a cylindrical duct 17 which is open on its upper end. The cylindrical wall of duct 17 is pierced near end panel 10 by two radially extending exhaust ports 18. A reservoir 19, used to apply compressed gas pressure to piston during a dispensing operation, is capable of sliding within duct 17. This reservoir 19 is a pressurised reservoir closed by a valve whose outlet tube 20 is arranged opposite the opening 16 in the end wall of cylinder 9. In this embodiment the reservoir 19 contains a liquefied gas, for instance, a butane/propane mixture at a pressure of 5 bars. The outlet tube 20 seats on an annular seal 21 arranged within a cylindrical cavity cut out at the bottom of opening 16 in duct 17. Reservoir 19, which may be displaced within duct 17, has an end panel 21 projecting upwardly in relation to, i.e. outwardly of, the said duct 17.

The operation of the storage and dispensing device described above is effected as follows. To effect a dispensing operation, the user presses on the upper end panel 21 of reservoir 19 to cause the outlet tube 20 to be lowered and to open the discharge or ejection valve (not shown) of the pressurised reservoir 19. The discharge flow of gas delivered by reservoir 19 penetrates through opening 16 into the hollow cylinder 9 and thereby drives piston 7 and push button 3 to slide downwardly and consequently to eject a determined quantity of the product via the ejection nozzle 5.

When the user releases his depressing pressure on panel 21 of reservoir 19, the discharge valve of the pressurised reservoir 19 is closed and the compressed gas situated within the hollow cylinder 9 may pass through the opening 16, between the seal 21 and the outlet tube 20 which no longer bears against the said seal, to escape through the abovementioned exhaust ports 19 provided for this purpose. Piston 7, subjected to the action of push button 3 of pump 2, may then rise again towards the upper end of cylinder 9 and in so rising, causes a fresh quantity of the product to be admitted into the dispensing chamber of pump 2, this quantity of the product being then able to be dispensed when the pressurised reservoir 19 is once more depressed.

In this embodiment, a pressurised reservoir 19 holding 21 $cm^3$ of liquefied gas at a pressure of 5 bars is provided for use with a container 1 which houses 100 $cm^3$ of the liquid product to be dispensed. A hand pump 2 of a conventional type allows 0.14 $cm^3$ of the liquid product to be dispensed at each operation. The pneumatic servo device 6 described above makes it possible to apply to push button 3 during each dispensing operation, a force of approximately 15 kgf which is well above that normally developed by a direct manual action on push button 3.

Figure 2:
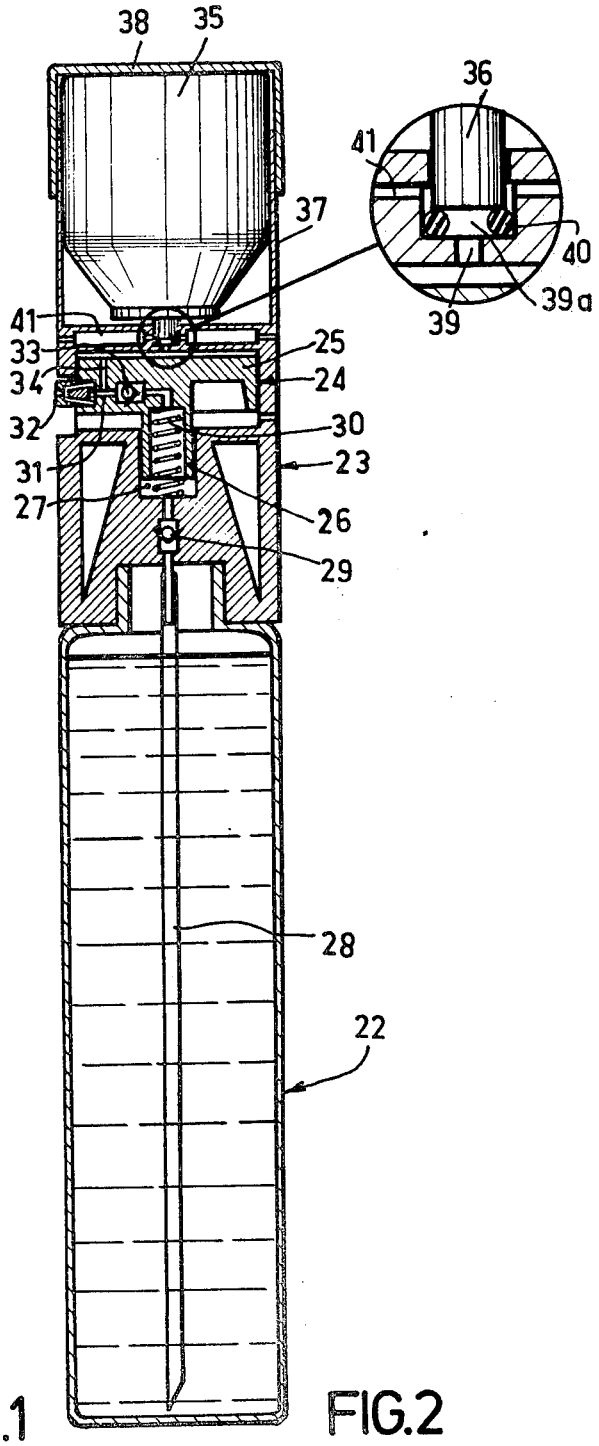
FIG. 2 represents an axial cross section of an alternative form of storage and dispensing container fitted with a pneumatic assistance system, in which the movable member of the system constitutes the piston of the ejection pump of the container and carries the ejection nozzle.

Referring to FIG. 2, there will be seen another embodiment of the device according to the invention, in which the hollow cylinder slidably housing the piston of the pneumatic servo device constitutes the body itself of the pump, the piston of the pneumatic servo system being used to produce directly both the admission of the liquid product to be dispensed into the dispensing chamber and its ejection through the ejection orifice of a nozzle 32.

This embodiment has a container vessel 22 containing the liquid product to be dispensed, and the pump 23 connected to the container vessel 22. The body of pump 23 comprises a stepped hollow cylinder slidably enclosing a stepped piston 24 of generally cylindrical shape. At its larger diameter upper part, the stepped cylinder slidably encloses a cylindrical head 25 of piston 24, and at its smaller diameter part it encloses a slidably a cylindrical rod 26 of a smaller diameter arranged coaxially with head 25.

A dispensing chamber 27 is delimited between the lower end of the piston rod 26 and the constricted section of the stepped cylinder; this communicates via an axial channel with a dip tube 28 arranged within container 22 and a non-return valve 29 is arranged in this axial channel. Rod 26 of piston 24 is pierced axially by a bore which houses a return spring 30. The bore cut out in rod 26 further communicates, by way of a tube system 31 cut out radially in the cylindrical head 25 of the piston, with the orifice of an ejection nozzle 32. Another non-return valve 33 is arranged in the tube system 31. In this embodiment, the ejection nozzle 32 is accommodated in a cylindrical recess formed in the side wall of the cylindrical head 25 of piston 24. In the wall of head 25, there has also been provided a tube system 34 communicating the orifice of the ejection nozzle 32 with the side of the piston head 25 on which the compressed gas pressure from a reservoir 35 is exerted during a dispensing operation. The tube system 34 allows the deflection, into the ejection nozzle 32, of a supply of compressed gas which thus serves both to improve the atomising jet and to clear the nozzle 32 at the end of the dispensing step.

The control of pump 23 is ensured by the above-mentioned pressurised reservoir 35 allowing the pressure of compressed gas to be applied on piston 24. The pressurised reservoir 35 has a conventional type of discharge valve fitted with an outlet tube 36. The pressurised reservoir 35 is slidably mounted within a cylindrical guide duct 37 arranged along the axis of sliding of piston 24. The end panel of the pressurised reservoir 35, projecting outwardly from the guide duct 37 is accommodated in a cap 38 placed over the guide duct 37, this cap 38 being slidable in duct 37 under the effect of pressure exerted by the user in the vertical direction (as viewed in the drawing).

The outlet tube 36 of the discharge valve of reservoir 35 is arranged opposite an opening 39 cut into the bottom wall of the guide duct 37, as shown in the enlarged detail shown in FIG. 2. This opening communicates the interior space of the guide duct 37 with that of the enlarged end of the stepped cylinder within which end the head 25 of piston 24 is slidable. At the mouth of opening 39 into the guide duct 37 there is provided a cylindrical cavity **39*a* within which an O ring seal 40 is arranged so as to engage the end of the outlet tube 36 of the pressurised reservoir 35. In the thickness of the bottom wall of guide duct 37, channels 41 are formed for exhausting the compressed gas delivered by reservoir 35; these channels 41 extend radially and open at one end outside the pump barrel and at the other side within the cylindrical cavity 39*a***.

The device of FIG. 2 functions as follows: When the user presses on cap 38, he causes the outlet pipe 36 of the pressurised reservoir 35 to be driven into the reservoir and a discharge quantity of gas to be ejected within the top part of the cylinder where the piston head 25 is located. This depresses the piston head 25 and consequently lowers the piston rod 26 into chamber 27 to open the valve 33 and thereby to eject the dose of the product contained in chamber 27, via the orifice of nozzle 32. A part of the compressed gas delivered from reservoir 35 passes into the ejection nozzle 32 and has the effect of improving the degree of atomisation of the spray jet.

When the user releases his depressing action, the discharge valve of the pressurised reservoir 35 closes, and the compressed gas already delivered will pass upwardly through the orifice 39 and then, through seal 40 and outlet tube 36, will escape via the channels 41. A part of the returning compressed gas will continue to pass via tube system 34 towards the discharge orifice of the ejection nozzle 32 after the dispensing of the dose of the product contained in chamber 27, this has the effectof clearing the ejection nozzle and of preventing it from clogging. Since the piston 24 is no longer subjected to a downward force exerted by the compressed gas, it can rise under the action of its return spring 30 to allow valve 29 to open and to admit a new quantity of the product into dispensing chamber 27. The user may then again press on cap 38 to eject a new dose of the product.

In such a device, the stepped piston 24 allows the pressure of the compressed gas applied to it during a dispensing operation to be multiplied in the ratio of the cross section of the piston head 25 to that of the piston rod 26. Thus, on the basis of a pressurised reservoir 35 containing a liquefied gas at a reduced pressure of the order of 5 bars, very high ejection pressures may be reached in all safety, which improves the quality of the atomised jet without requiring the use of a propellant gas as has been the case until now with pressurised containers of the "aerosol container" type.

Figure 3:
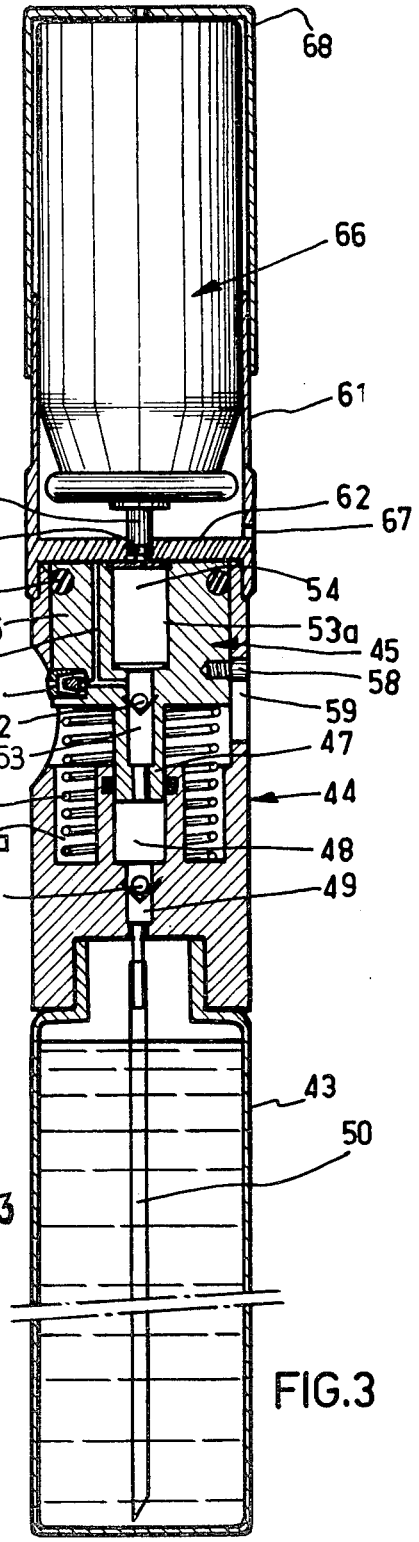
FIG. 3 represents an axial cross section of an alternative embodiment of the device of FIG. 2, this variant allowing a large dose of the product to be ejected with each dispensing operation and comprising an additional gas intake which is connected to the ejection nozzle.

FIG. 3 of the drawing shows an alternative embodiment of the device of FIG. 2, in which provision is made for the piston associated with the container to travel through a long stroke in order to deliver continuously, for a relatively long period of the order of about ten seconds, a large dose of the product.

The device shown in FIG. 3 comprises an un-pressurised container vessel 43 connected to an ejection pump 44 comprising a pneumatic servo system. The barrel of pump 44 has a cylindrical inner chamber slidably receiving a piston 45 of generally cylindrical shape. As in the embodiment of FIG. 2, the cylinder is stepped, and the piston 45 comprises, on the one hand, a cylindrical head capable of displacement in the enlarged section of the stepped cylinder and, on the other hand, a rod 47 capable of displacement in the constricted section of the cylinder. The constricted section delimits with piston rod 47 a dispensing chamber 48 which communicates via an axial channel 49, with a dip tube 50 arranged within container vessel 43. A first non-return valve 51 is arranged in axial channel 49. The seal between the piston rod 47 and the dispensing chamber 48 is ensured by an O ring. Piston rod 47 is pierced axially by a bore 53 which includes another non-return valve 52. Bore 53 is extended axially within the piston head 46 by a cylindrical cutout 53*a* obturated on its upper part by means of a separately formed disc 54; the cylindrical cutout 53*a* permits valve 52 to be positioned within bore 53 when the pump is being assembled.

On its side wall the piston head 46 comprises an ejection nozzle 55 whose orifice communicates via a radial duct with the inside space of bore 53 above valve 52. The orifice of the ejection nozzle 55 also communicates, via a tube system 56 formed parallel to the axis of piston head 46, with the space where the pressure of the compressed gas is to be exerted on the top of piston head 46. The seal between piston head 46 and the larger diameter section of the stepped cylinder within which it is sliding, is ensured by means of an O ring seal 57. Piston head 46 has a guide finger 58 projecting outwardly from its side wall to be inserted within a rectangular groove 59 formed in the wall of the pump barrel and arranged parallel to the sliding axis of piston 45. This guide finger 58 within groove 59 makes it possible to prevent rotation of piston 45 in relation to the pump barrel.

The piston 45 is subjected to the action of a return spring 60 arranged around the piston rod 47 and dispensing chamber 48. This spring 60 bears, on the one hand, against the bottom of an annular recess 60*a* in the pump barrel around dispensing chamber 48 and, on the other hand, against the corresponding end of the piston head 46.

The pump barrel 44 is surmounted by an attached component constituting a cylindrical duct 61 obturated at its lower end by a bottom wall 62. This bottom wall 62 is pierced axially by an opening 63 communicating the inner space of duct 61 with that of the upper part of the cylinder in which piston head 46 slides. At the mouth of opening 63 into duct 61 is a cylindrical cavity within which there is inserted a seal on which engages the outlet tube 64 of a pressurised reservoir 66. The side wall of duct 61 includes radial exhaust ports 67 allowing the gas delivered by reservoir 66 to be evacuated after a dispensing operation. The end panel of reservoir 66 is accommodated in a cap 68 mounted slidably a round guide duct 61.

The mode of functioning of the devices of FIG. 3 is substantially similar to that of FIG. 2. By pressing on cap 68, the user drives the outlet tube 64 of the discharge valve of the pressurized reservoir inwardly, i.e. upwardly relative to the reservoir, and causes the application of compressed gas pressure on piston head 46. Piston 45 is thereby displaced to compress return spring 60 and to cause one way valve 52 to open and cause ejection of the liquid product contained in the dispensing chamber 48. During the lowering action of piston 45, a quantity of the discharged compressed gas passes into tube system 56 to be dispensed with the dose of the product through the orifice of the ejection nozzle 55. Since the displacement of the piston 45, 46 is relatively slow, a jet spray of long duration is obtained, and this may be interrupted at any moment by relaxing the pressure exerted on cap 68. At that moment, the discharge valve of the pressurized reservoir will close and the compressed gas already in the stepped cylinder may be exhausted towards the outside, as in the case of the embodiment of FIG. 2, via the exhaust ports 67. Piston 45, being no longer subjected to the compressed gas pressure, rises under the thrust exerted by return spring 60 to close valve 52 while valve 51 opens to introduce a new dose of the product into dispensing chamber 48.

Figure 4:
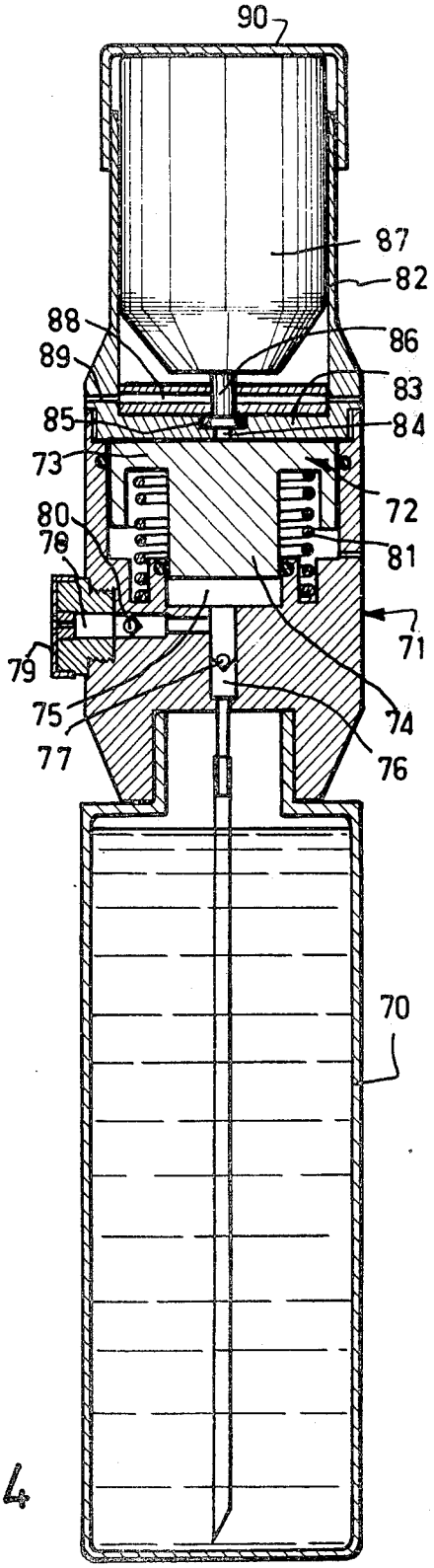
FIG. 4 represents an axial cross section of another alternative embodiment of the device represented in FIG. 2; the ejection nozzle being in this variant, carried by the pump barrel.

FIG. 4 of the drawing shows another alternative embodiment of the device of FIG 2. In this embodiment the ejection or dispensing nozzle is carried by the pump barrel. The device represented in FIG. 4 comprises an unpressurized container vessel 70 containing a liquid product to be dispensed. A pneumatically assisted pump 71 has been fitted on container vessel 70. Within the barrel of pump 71 is a stepped cylinder which slidably encloses a generally cylindrical piston 72, as in the embodiments of FIGS. 2 and 3.

Piston 72 comprises a head 73 displaceable in the enlarged cross section end of the stepped cylinder and a piston rod 74 displaceable within the smaller cross section zone of the said cylinder. This smaller cross section zone delimits, with the piston rod 74, a dispensing chamber 75 which communicates via an axial bore 76 with a dip tube arranged within container 70. A non-return valve 77 is placed within the axial bore 76. The dispensing chamber 75 also communicates, via a radial channel 78 with the orifice of an ejection nozzle 79. A further non-return valve 80 is arranged in the radial channel 78. The ejection nozzle 69 is screwed into a bore in the side wall of the pump barrel.

Piston 72 cooperates with a return spring 81 surrounding piston rod 74 and the dispensing chamber 75. The stepped cylinder in which piston 72 slides is obturated at its upper part by an attached component constituted by a cylindrical duct 82 and a bottom panel 83 arrranged perpendicularly to the axis of the said duct. This bottom 83 is pierced axially by an opening 84 which communicates the inside space of the cylinder with that of duct 82. At the mouth of opening 84, in duct 82, is a cylindrical cavity where seal 85 is inserted. The outlet tube 86 of a pressurized reservoir 87 slidable within duct 82 bears on this seal 85. On the bottom 83 of the duct is an assembly formed by two superimposed discs which are connected by distance pieces to define between the two discs a gap 88 which opens to the outside of the pump via ports 89. The two superimposed discs are traversed by the outlet tube 86 and for this purpose the diameter of the hole cut out in the upper disc is adjusted to that of the outlet tube 86 passing through it. The end panel of the pressurized reservoir projects upwardly out of the cylindrical duct 82 and is covered by a cap 90 placed on the duct 82 and capable of sliding in relation to it.

The functioning of the device which has just been described is similar to that of the devices represented in FIGS. 2 and 3. In this case too, stepped piston 72 multiplies the compressed gas pressure applied to it during a dispensing operation in the ratio of the effective cross sections of piston head 73 and piston rod 74. Thus, on the basis of a relatively low gas pressure of the order of a few bars in the reservoir 87 a high ejection pressure may be obtained thanks to the pressure multiplying effect of the piston 72. It may also be noticed that the spray will be interrupted when the user relaxes his pressure on cap 90. At that moment, the ejection of the compressed gas is interrupted and the gas delivered may be exhausted via opening 84, space 88, and the exhaust ports 89.

Figure 5:
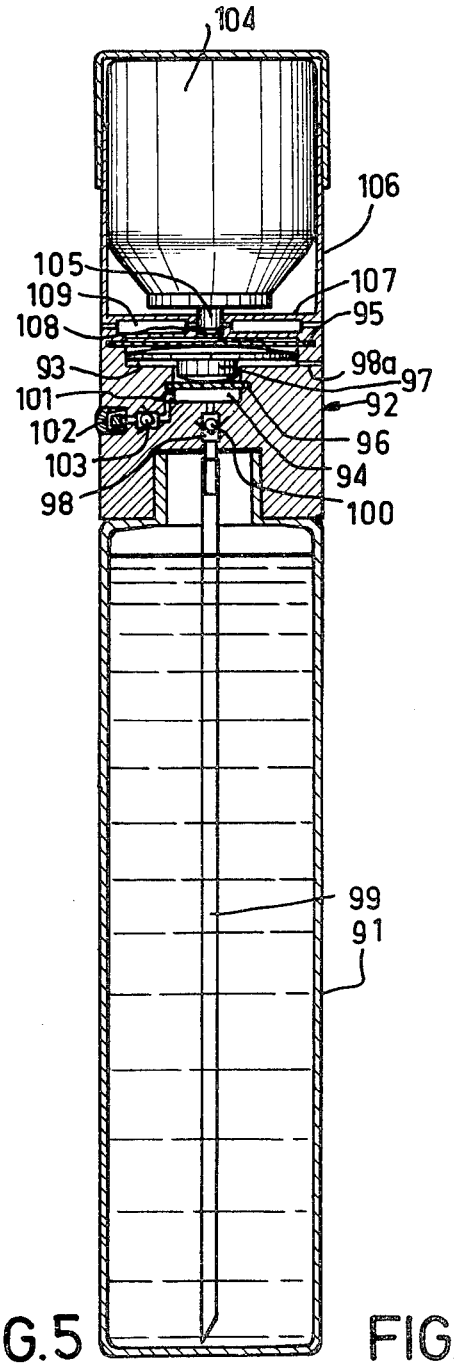
FIG. 5 represents an axial cross section of another embodiment of the container of the invention, in which the movable member of the pump is a piston enclosed between two elastically deformable membranes.

FIG. 5 shows an unpressurized container vessel 91 associated with a pump 92 equipped with a pneumatic servo system. In the barrel of pump 92, is a stepped cylinder having an enlarged cross section in its upper part 93 and a smaller cross section in its lower part 94. In this embodiment, the movable member of the pump is a piston 97 inserted between two elastically deformable membranes 94 and 95. These two membranes are arranged parallel to each other and perpendicularly to the axis of the pump barrel. The upper membrane 95 obturates the enlarged cross section part 93 of the stepped cylinder, while the lower membrane 96 obturates the smaller cross section part 94 of the said cylinder. The space comprised between the two membranes 95 and 96 communicates with the outside via a vent hole 98*a*. Piston 97 comes into contact with the two membranes 95 and 96 and presents, for each of these two membranes, respective bearing surfaces of varying dimensions whose ratio determines the multiplication factor of the action of the compressed gas acting on the membrane 95. The lower membrane 96 delimits, with the side wall of lower zone 94 of the stepped cylinder, the dispensing chamber of pump 92. This dispensing chamber communicates via an axial channel 98 with a dip tube 99 accommodated within the container 91. A non-return valve 100 is located in the axial channel 98. The dispensing chamber also communicates, via a tube system 101, with the orifice of an ejection nozzle 102 carried by the pump barrel. A further non-return valve 103 is arranged in this pipe system 101.

The source of auxiliary energy required for the pneumatic servo assistance for the pump is a compressed gas delivered by a pressurised reservoir 104 which contains, for example, a liquefied gas at a relatively low pressure. This pressurised reservoir 104 comprises, in a conventional manner, an ejection valve fitted with an outlet tube 105. The pressurised container 104 is accommodated in a cylindrical duct 106 arranged as a co-axial extension of pump barrel 92. Duct 106 terminates at a bottom wall 107 along whose axis is an opening communicating the inside of the enlarged cross section part 93 of the stepped cylinder with the interior of duct 106. At the mouth of this opening, within duct 106, is a cylindrical cavity in the bottom of which an O ring 108 is inserted. The end of the outlet tube 105 of the pressurised reservoir 104 engages the O ring 108, in the manner illustrated more clearly in the detail of FIG. 2. In the bottom wall 107 are radial channels 109 which open at one end outside the pump barrel and, at the other end, within the cylindrical cavity where the O ring 108 is inserted on which outlet tube 105 engages.

The operation of the device of FIG. 5 is as follows. By pressing on the end panel of the pressurised container 104 the user depresses outlet tube 105 of the discharge valve of reservoir 104 by pressing it against O ring 108; this leads to an ejection of compressed gas from the reservoir 104 onto the upper face of the upper membrane 95. The compressed gas pressure produces an elastic deformation of this membrane 95 and displacement of the piston with elastic deformation of lower membrane 96; the gas pressure is multiplied in the ratio of the contact cross sections of stepped piston 97 with the two membranes. The downward displacement of membrane 96 increases the pressure of the liquid in the dispensing chamber, causing the valve 103 to open and discharging, as spray from the ejection nozzle 102, the dose of product previously in the dispensing chamber.

When the user relaxes his depressing action, the outlet tube 105 of the reservoir 104 returns to its initial position, and the ejection valve closes. The volume of compressed gas introduced into the pump cylinder may then be exhausted by passing between the O ring seal 108 and the outlet tube 105 to escape to the atmosphere via the evacuation channels 109. In returning to its initial position, the membrane 96 produces closing of valve 103, opening of valve 100 and the intake into the dispensing chamber 94 of a new dose of the product to be dispensed. It should be noted that, because of its smaller cross section, the lower membrane 96 has a greater rigidity which allows it to serve as a return spring for the piston 97.

Figure 6:
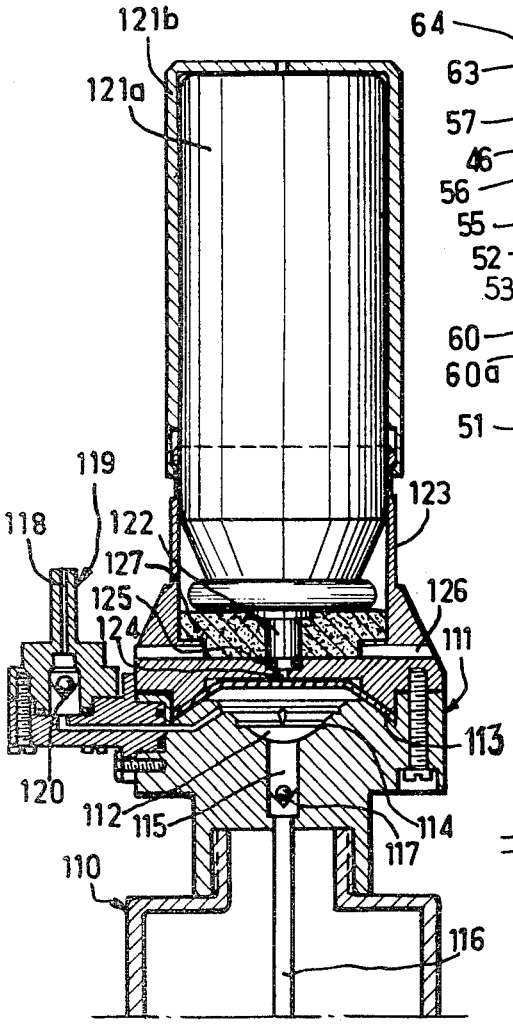
FIG. 6 represents an axial cross section of another embodiment of the container of the invention in which the movable pump member is an elastic membrane.

FIG. 6 shows an unpressurised container vessel 110 connected to a pump 111. In the body of pump 111, is a dispensing chamber 112 whose upper wall is formed by an elastic membrane 113. This membrane is dome-shaped when it is not subjected to the action of the compressed gas, its concavity being on the side facing towards the dispensing chamber 112. The dispensing chamber 112 has, opposite the elastic membrane 113, a concave curved wall in which are two circular grooves 114 which communicate with each other. The dispensing chamber 112 communicates via an axial channel 115, with a dip tube 116 arranged in the container vessel 110. A non-return valve 117 is located in the axial channel 115. The dispensing chamber also communicates with the channel 118 of a fitting 119 on which the ejection nozzle (not shown) is to be arranged. A non-return valve 120 is inserted between channel 118 of the fitting 119, and the distribution chamber 112.

The pump 111 is surmounted by a pressurised reservoir 121*a* whose discharge valve is fitted with an outlet tube 112. This reservoir 121*a* is fitted into a duct 123 arranged as a coaxial extension of the pump barrel. The end panel of container 121*a* is accommodated in a cap 121*b* slidably mounted round the guide duct 123. At the bottom of the guide duct 123 is a communication opening 124 extending along the axis of the said duct and opening opposite the convex side of the elastic membrane 113. An O ring seal 125 is inserted into a cylindrical cavity between the communication opening 124 and the guide duct 123. The outlet tube 122 of the pressurised reservoir 121*a* engages this O ring. Radial exhaust channels 126 provided near the bottom of duct 123 open at one end outside the pump barrel and, at the other end, within the duct 123. Within the duct, between its bottom panel and the pressurised reservoir 121*a*, is a foam layer 127 which is used to reduce the noise of the compressed gas escaping via the radial channels 126 following a dispensing operation.

The device of FIG. 6 described above functions as follows. By pressing on cap 121*b*, the user causes the outlet tube 122 to be depressed as it bears against O ring 125. This release gas onto the convex side of the elastic membrane 113 subjecting it to gas pressure which deforms it and causes it to bear against the curved concave wall of dispensing chamber 112. The downward displacement of membrane 113 has the effect of increasing the pressure obtaining within the distribution chamber 112 and consequently of opening the valve 120 to eject the dose of product from the dispensing chamber; the ejection is total thanks to the presence of two circular grooves 114.

When the user relaxes his action, the volume of compressed gas which has been delivered may escape, between the O ring seal 125 and the outlet tube 122 which will have returned to its initial position, to pass through the foam layer 127 and the radial channels 126 to escape to the atmosphere. The membrane 113, which is no longer subjected to the action of the compressed gas, may thanks to its inherent elasticity obtained by its dome shape also return to its initial position shown in FIG. 6. In returning into its original position the membrane 113 causes the closing of non-return valve 120, opening of non-return valve 117 and the induction of a new dose of the product into the dispensing chamber.

In this embodiment, the elastic membrane 113 does not produce a multiplication or amplification of the compressed gas action applied to it. However, ejection pressure may nevertheless be increased, in relation to that which would be obtained manually, without the servo device, if a pressurised reservoir 121*a* is used containing, for instance, a liquefied gas at high pressure.

We claim:

1. A dispensing container for storing and dispensing a liquid product, comprising a container vessel, a liquid product in said container vessel, and a pump which comprises:

(a) a dispensing chamber, (b) ejection orifice means, (c) one-way flow means communicating said dispensing chamber with said ejection orifice means, (d) one-way flow means communicating said dispensing chamber with the interior of said container vessel, (e) a movable control member effective to ensure introduction of the liquid product from said container vessel into the dispensing chamber and discharge thereof from said dispensing chamber towards said ejection orifice means by alternating displacement of said control member, and (f) means for applying gas pressure from compressed gas to one end of said movable control member during a dispensing operation, said gas pressure applying means comprising a pressurized reservoir, an ejection valve on said reservoir, and manually operable means for displacing said reservoir to actuate said valve to open during a dispensing operation, and wherein a guide duct displaceably receives said pressurized reservoir, said pressurized reservoir having a part which projects outwardly from said guide duct, and said manually operable means comprises a cap slidably fitted on said guide duct for movement with respect to said guide duct to displace said reservoir relative to the guide duct under the action of pressure exerted on said cap by the user.

2. A dispensing container according to claim 1, wherein said movable control member is a piston slidably mounted within a cylinder; said guide duct has an inner wall with an opening therein communicating with said cylinder in which the movable piston is slidable; and wherein the ejection valve of the pressurized reservoir is in communication with said opening.

3. A dispensing container according to claim 2, wherein a cylindrical cavity is formed between said opening and said guide duct and an O-ring seal is arranged in said cylindrical cavity, and wherein an outlet tube of said ejection valve of said pressurized reservoir bears against said O-ring seal during eacn opening operation of said ejection valve.

4. A dispensing container according to claim 1, and including exhaust port means in the wall of said guide duct for allowing exhausting of said gas delivered by said pressurised reservoir during a dispensing operation.

5. A dispensing container according to claim 4, wherein said exhaust port means are located near the ejection valve of said reservoir.

6. A dispensing container according to any one of claims 2 and 3 to 5, wherein said pump is a hand pump of conventional push-button operated type and said piston has its end which is not subjected to the pressure of the compressed gas engaging the push-button of said hand pump.

7. A dispensing container according to claim 6, wherein said pump has a body and includes duct means for supplying compressed gas from at least one of said pump body and said movable control member to said ejection orifice means.

8. A dispensing container according to claim 6, wherein said cylinder is a stepped cylinder and wherein two elastically deformable membranes are provided parallel to one another and extending transversely across said stepped cylinder with said piston placed between said two membranes, an upper of said two membranes closing the larger cross-section end of said cylinder and withstanding the pressure of compressed gas during a dispensing operation, and the lower of said two membranes closing the smaller end of said stepped cylinder and constituting a wall of said dispensing chamber of the pump.

9. A dispensing container according to claim 8, wherein said lower membrane is dome-shaped and has its concavity on the face nearer said piston.

10. A dispensing container according to claim 9, and including guide finger means carried by said piston and rectangular groove means formed in said cylinder and extending parallel to the axis of symmetry of said cylinder, said guide finger means being slidably received within said groove means.

11. A container according to any one of claims 1, 2 and 3 to 5, wherein said movable control member is a movable member of the pump and displacement of said movable member in one direction effects pumping of the liquid product into said dispensing chamber and, in the other direction, effects pumping of the product through said ejection orifice means.

12. A dispensing container according to claim 11, wherein said pump comprises a body and a stepped cylinder formed in said body, and wherein said movable control member is a stepped piston in said stepped cylinder, said piston having a zone of enlarged cross-section on which said compressed gas pressure acts during dispensing and a zone of narrower cross-section bordering on said dispensing chamber of the pump.

13. A dispensing container according to claim 11, wherein said pump comprises a pump body and duct means in at least one of said pump body and said movable control member for allowing supply of compressed gas from said pump to said ejection orifice means.

14. A dispensing container according to claim 11, wherein said movable control member is a stepped piston of cylindrical cross-section and said cylinder is of stepped form, and wherein a return spring is arranged within said pump for biasing said piston against the action of said gas pressure.

15. A container according to claim 14, wherein said ejection orifice means comprise a nozzle carried by said piston.

16. A dispensing container according to claim 14, wherein said ejection orifice means comprise a nozzle carried by said cylinder.

17. A dispensing container according to claim 14, wherein said return spring is a helical spring arranged within said dispensing chamber of the pump.

18. A dispensing container according to claim 14, wherein said return spring is a helical spring arranged annularly around said dispensing chamber and wherein said spring bears at one end against said cylinder and at the other end against said larger cross-section part of the piston.

19. A dispensing container according to claim 11, wherein said movable control member comprises an elastic membrane having one side subjected to the action of compressed gas during a dispensing operation and the other side constituting a wall of said dispensing chamber.

20. A dispensing container according to claim 19, wherein said elastic membrane is dome-shaped and has concavity on the side facing towards said dispensing chamber.

21. A dispensing container according to claim 19, wherein said dispensing chamber has, opposite the elastic membrane, a curved concave wall on which the membrane rests when subjected to gas pressure during dispensing, and wherein grooves are formed in said curved concave wall.

* * * * *